US007128599B1

(12) United States Patent
Ho

(10) Patent No.: US 7,128,599 B1
(45) Date of Patent: Oct. 31, 2006

(54) LOW PROFILE MICROPHONE CONNECTOR

(75) Inventor: Hsin-Tsung Ho, Tu-Cheng (TW)

(73) Assignee: Cheng UEI Precision Industry Co., Ltd, Taipei Hsien (TW)

( * ) Notice: Subject to any disclaimer, the term of this patent is extended or adjusted under 35 U.S.C. 154(b) by 0 days.

(21) Appl. No.: 11/374,116

(22) Filed: Mar. 14, 2006

(51) Int. Cl.
*H01R 3/00* (2006.01)

(52) U.S. Cl. ..... 439/500; 439/620.25

(58) Field of Classification Search ..... 439/500, 439/68, 78, 620.24, 620.25
See application file for complete search history.

(56) References Cited

U.S. PATENT DOCUMENTS 5,823,820 A * 10/1998 Patel et al. ..... 439/500

* cited by examiner

*Primary Examiner*—Javaid H. Nasri
(74) *Attorney, Agent, or Firm*—Birch, Stewart, Kolasch & Birch, LLP

(57) ABSTRACT

A low profile microphone connector includes a dielectric housing and electrical terminals located in the housing. The housing has a generally cylindrical wall, a generally cylindrical microphone insertion cavity defined by the cylindrical wall, a supporting base formed at a lower portion of the cylindrical wall, and a plurality of ribs formed at an upper portion of the cylindrical wall. A PCB has a generally circular hole and a plurality of positioning slots defined along the periphery of the circular hole. In assembly, the cylindrical wall sinks into the circular hole of the PCB, the supporting base abuts against a bottom face of the PCB, and the ribs engage with the positioning slots to position the connector on the PCB. So the connector has a low profile over the PCB and reliably retained on the PCB.

10 Claims, 7 Drawing Sheets

LOW PROFILE MICROPHONE CONNECTOR

BACKGROUND OF THE INVENTION

1. Field of the Invention

This present invention relates to an electrical connector for mounting a microphone, such as a microphone of the disc type, and more specifically to a microphone connector mountable onto a printed circuit board (PCB) and having a low profile over the PCB.

2. The Related Art

Conventionally, in order to mount a microphone for a portable telephone set or the like, various mounting methods such as a method wherein a microphone itself is soldered to a printed circuit board or another method wherein a microphone is secured to a case of a body for the portable telephone set or the like and leads from the microphone are soldered to a printed circuit board are used to electrically connect the microphone and the printed circuit board to each other. Typical mounting structures and connecting methods are described below.

Referring to FIG. 7, a traditional microphone connector 50 comprises a housing 5, a cave 51 defined by the housing 5, a plurality of connecting terminals 52 located in the housing 5, contacting portions 521 of the connecting terminals 52 projecting into the cave 51, and solder portions 522 of the connecting terminals 52 extending outside the housing 5. The microphone connector 50 is welded on a printed circuit board 6 by the solder portions 522 of the connecting terminals 52. The microphone connector 50 accepts a microphone in the cave 51.

In the conventional microphone unit mounting structures described above, the microphone connector 50 is held between the microphone and the printed circuit board 6 to establish electric connection between the microphone and the printed circuit board 6. The microphone connector 50 and the microphone are totally retained over the printed circuit board 6. However, reduction in height has proceeded with portable telephone sets or the like in recent years. Therefore, the height of the traditional microphone connector located on the printed circuit board needs to be decreased.

Accordingly, in order to reduce the thickness of the body of the portable telephone set, it is necessary to reduce the thickness of each of the parts such as the microphone connector. In other words, the conventional microphone unit mounting structures described above has a problem in that, from a restriction to the dimension of the sum of the thickness of the microphone and the thickness of the microphone connector and the printed circuit board, the thickness of the body cannot be reduced.

SUMMARY OF THE INVENTION

An object of the invention is to provide a low profile microphone connector comprising a dielectric housing and a plurality of electrical terminals. The dielectric housing has a generally cylindrical wall, a generally cylindrical microphone insertion cavity defined by the cylindrical wall, a top open end and a bottom end. A supporting base is formed at a lower portion of the cylindrical wall and extends outwardly. The supporting base has a supporting surface opposite to the bottom end for abutting against a bottom face of a printed circuit board (PCB). A plurality of ribs is formed at an upper portion of the cylindrical wall and outside the cylindrical wall for positioning the connector on the PCB.

Each electrical terminal has a solder tail portion extending outside the dielectric housing from the supporting surface of the supporting base to be soldered to the PCB and a flexible contact portion projecting into the microphone insertion cavity for electrically engaging with a microphone which is inserted into the microphone insertion cavity through the top open end.

Another object of the invention is to provide an assembly of the low profile microphone connector and a printed circuit board (PCB). The printed circuit board has a generally circular hole and a plurality of positioning slots defined along the periphery of the circular hole. The cylindrical wall sinks into the circular hole of the PCB. The supporting surface of the supporting base abuts against a bottom face of the PCB, and the solder tail portions of the electrical terminals are soldered to the PCB. The ribs engage with the respective positioning slots to position the connector on the PCB. So the connector has a low profile over the PCB and reliably retained on the PCB.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
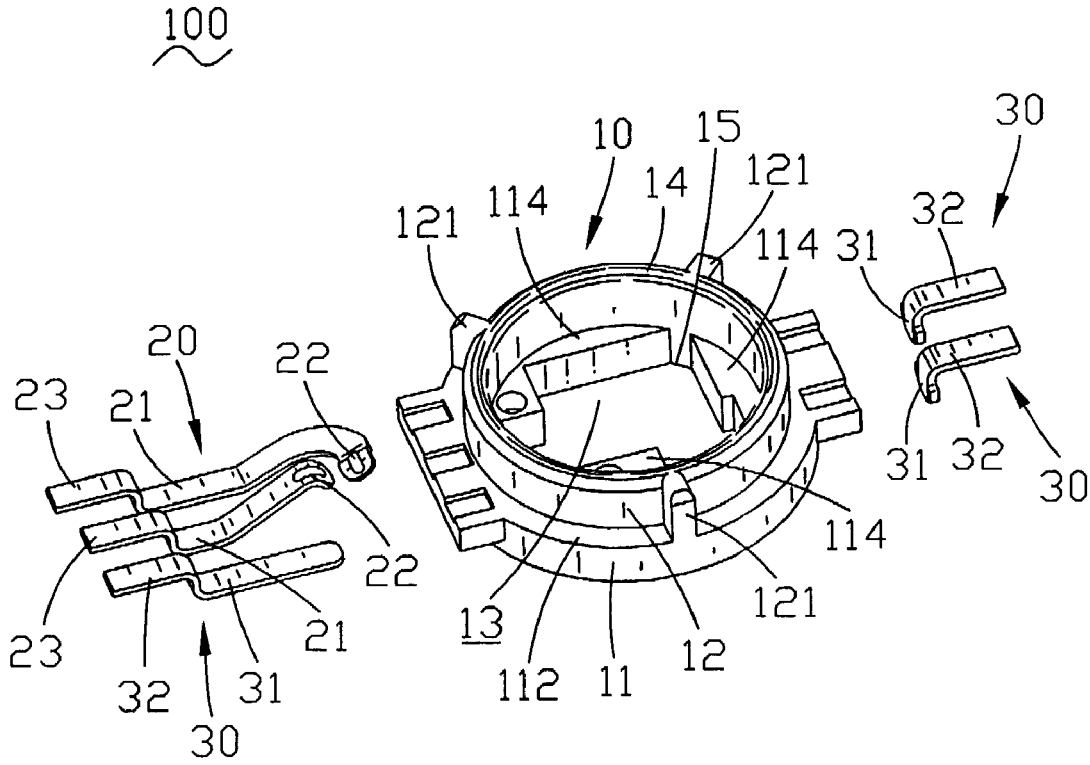
FIG. 1 is an exploded perspective view of a low profile microphone connector according to the present invention.

First referring to FIG. 1, a low profile microphone connector 100 according to the invention is shown. The microphone connector 100 comprises a dielectric housing 10, two pieces of electrical terminals 20, and three pieces of solder blades 30.

The dielectric housing 10 has a generally cylindrical wall 12, a generally cylindrical microphone insertion cavity 13 defined by the cylindrical wall 12, a stop shoulder 114 in the bottom of the microphone insertion cavity 13, a top open end 14, a bottom end 15, a supporting base 11 formed at a lower portion of the cylindrical wall 12 and extending outwardly, and three ribs 121 formed at an upper portion of the cylindrical wall 12 and outside the cylindrical wall 12. The supporting base 11 has a supporting surface 112 opposite to the bottom end 15. Preferably, the three ribs 121 are symmetrically distributed on the outer periphery of the cylindrical wall 12. That is, the included angle of every two ribs 121 is sixty degrees.

Each of the electrical terminals 20 has a base 21, a solder tail portion 23 extending from one end of the base 21, and a flexible contact portion 22 extending from the other end of the base 21. Each of the solder blades 30 has a body 31 and a solder part 32.

Figure 2:
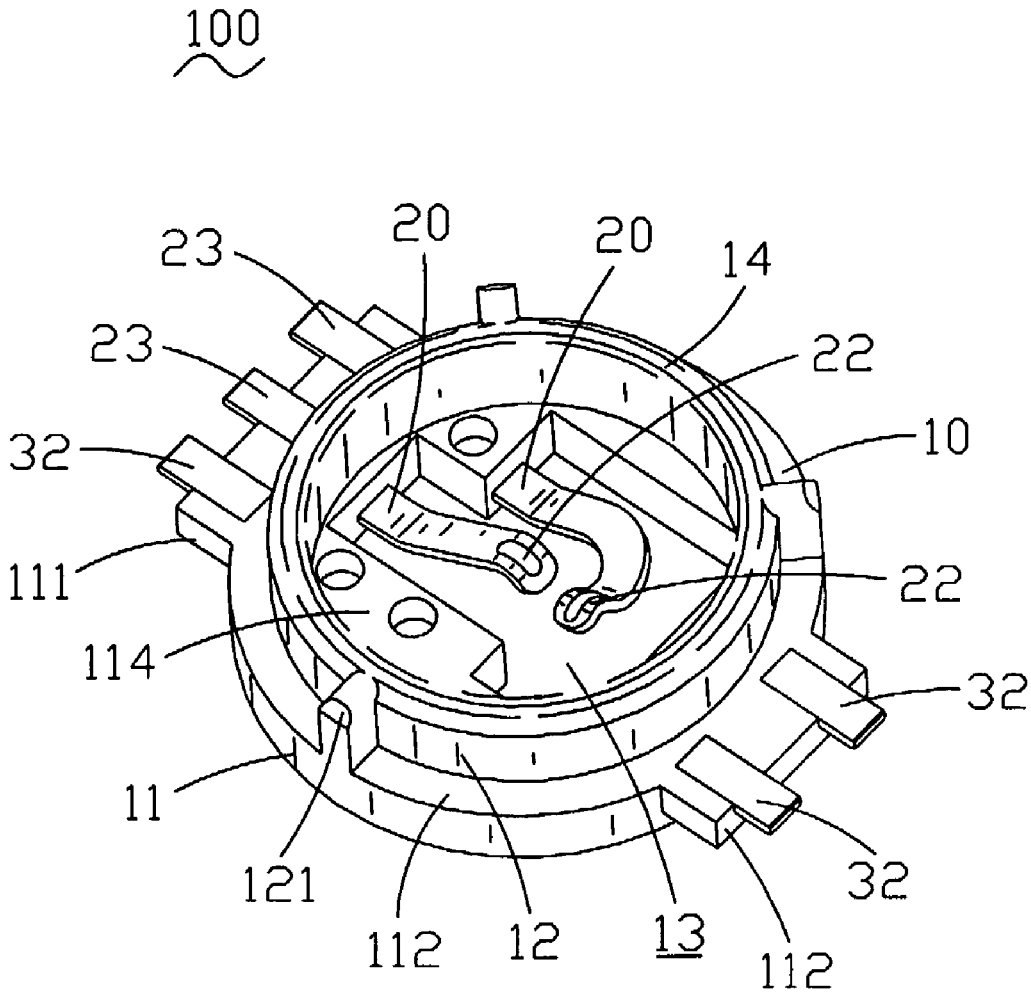
FIG. 2 is an assembled perspective view of the low profile microphone connector.
Figure 3:
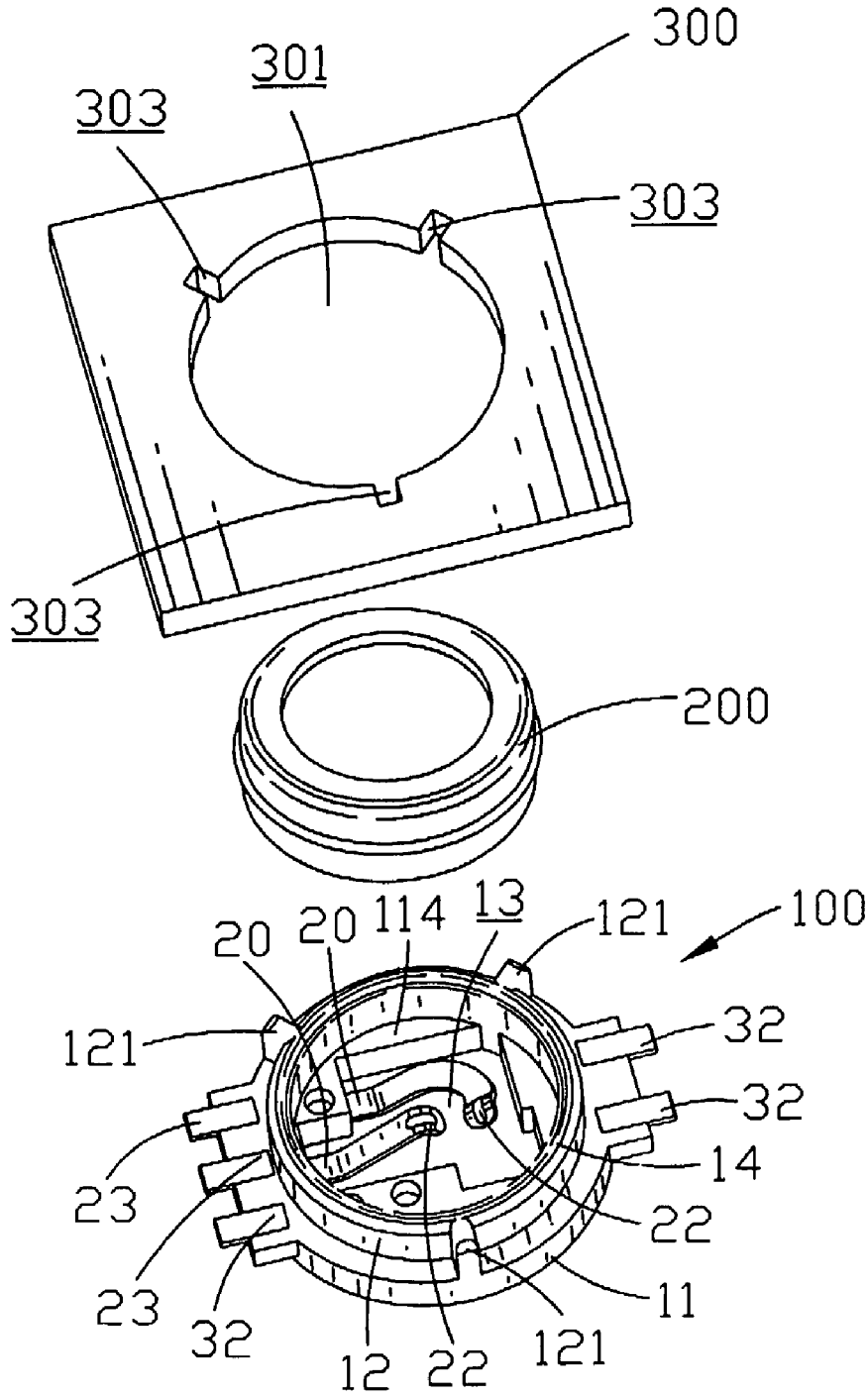
FIG. 3 is a perspective view of the low profile microphone connector, with a microphone and a printed circuit board (PCB) elevated above the connector.
Figure 4:
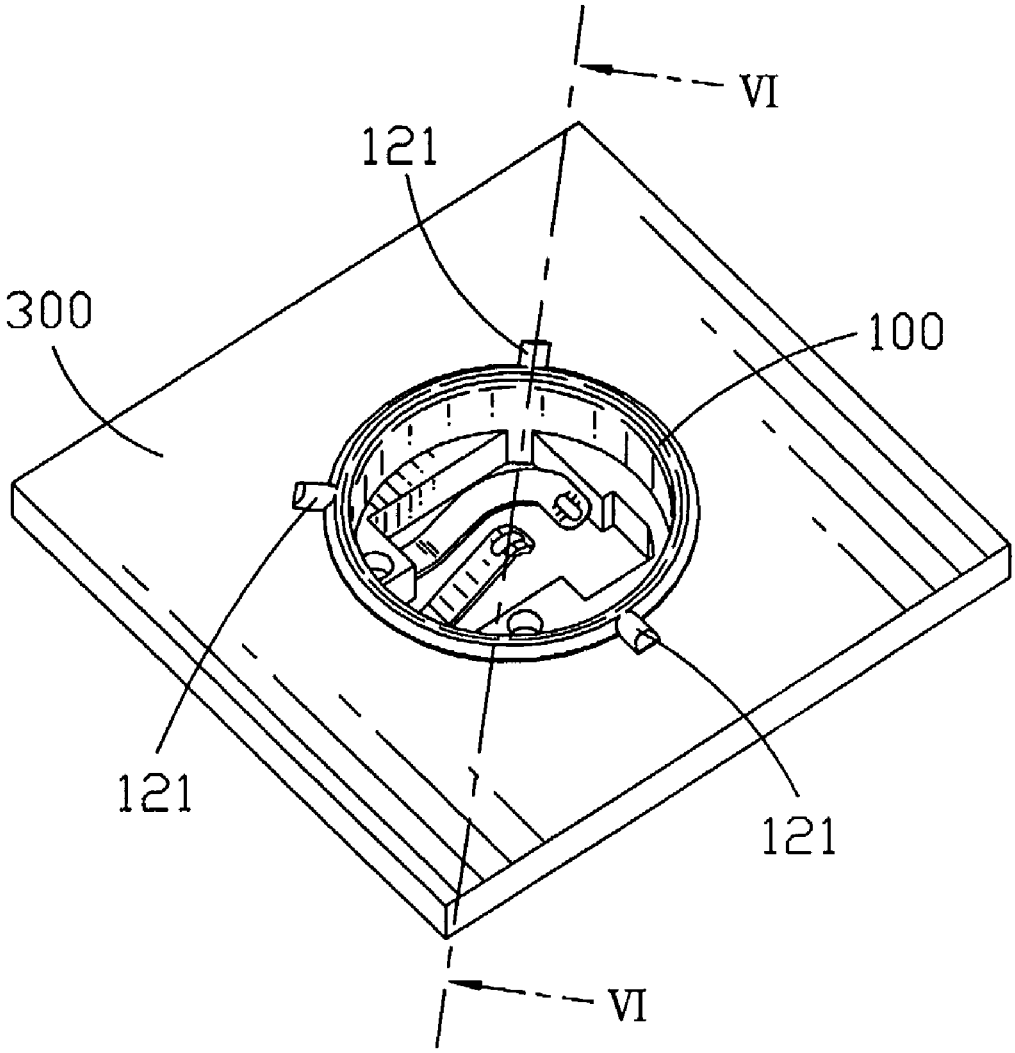
FIG. 4 is a perspective view showing the low profile microphone connector mounted onto the PCB.
Figure 5:
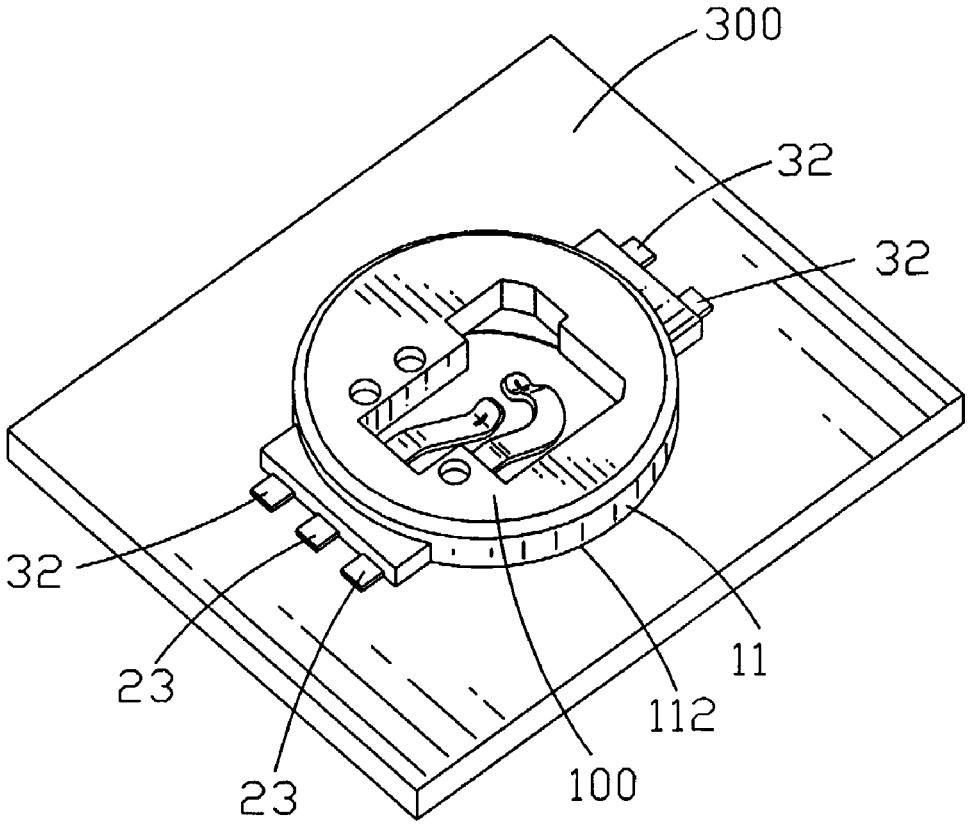
FIG. 5 is another perspective view of the assembly of the low profile microphone connector and the PCB.
Figure 6:
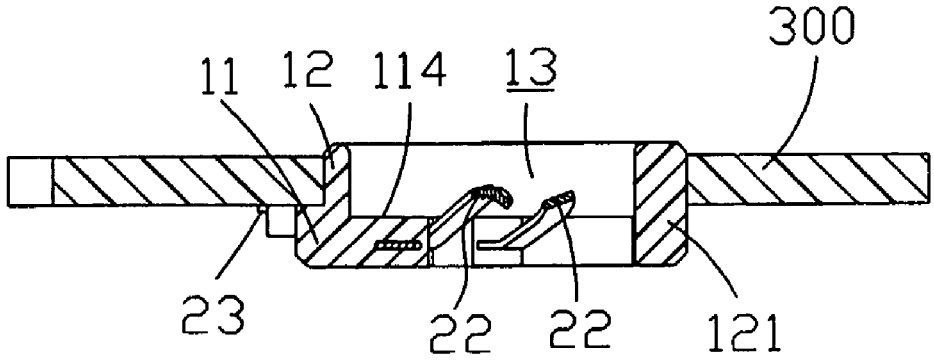
FIG. 6 is a cross-sectional view taken along line VI—VI of FIG. 4.
Figure 7:
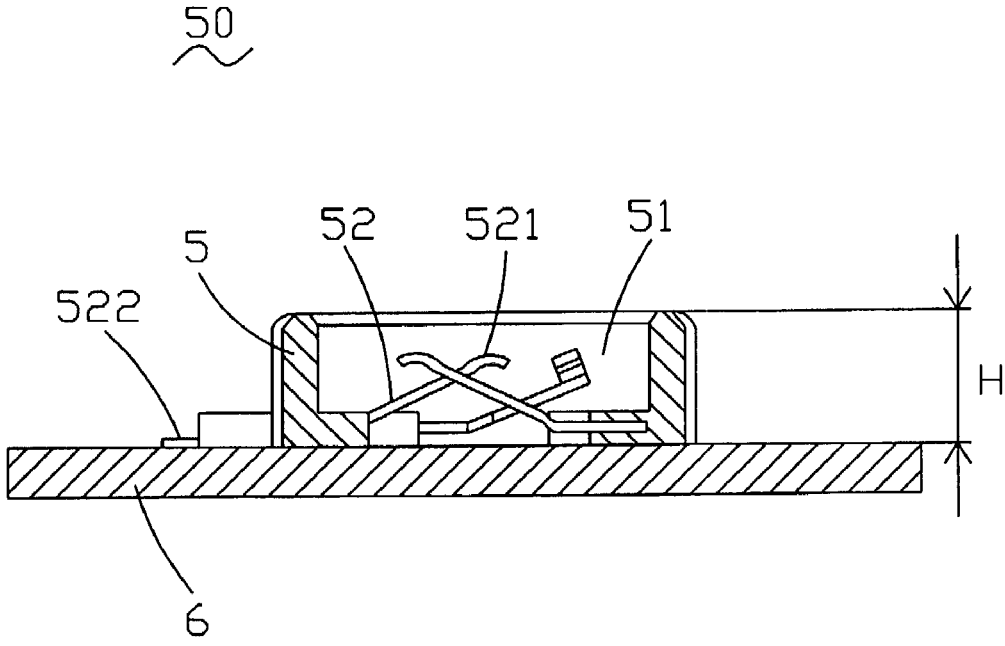
FIG. 7 (Prior Art)
FIG. 7 is a cross-sectional view of a traditional microphone connector.

Referring to FIG. 2, the electrical terminals 20 and the solder blades 30 are mounted in the supporting base 11 by insert molding. The solder tail portions 23 of the electrical terminals 20 and the solder parts 32 of the solder blades 30 extend outside the dielectric housing 10 from the supporting surface 112 of the supporting base 11. The solder tail portions 23 and the solder parts 32 are flush with each other and are flush with the supporting surface 112 of the supporting base 11. Preferably, the solder tail portions 23 and the solder parts 32 are symmetrically distributed. The flexible contact portions 22 of the electrical terminals 20 project into the microphone insertion cavity 13.

Please refer to FIGS. 3–6. While the low profile microphone connector 100 mounts a microphone 200, the microphone 200 is inserted into the microphone insertion cavity 13 of the dielectric housing 10 through the top open end 14, and the flexible contact portions 22 of the two electrical terminals 20 prop up the bottom of the microphone 200. A printed circuit board 300 used to assemble with the microphone connector 100 defines a circular hole 301 therein and three positioning slots 303 located along the periphery of the circular hole 301. Preferably, the positioning slots 303 communicate with the circular hole 301. In assembly, the cylindrical wall 12 of the insulating housing 10 sinks into the circular hole 301 of the PCB 300, the supporting surface 112 of the supporting base 11 abuts against a bottom face of the PCB 300 so that the connector 100 is retained on the PCB 300, and the ribs 121 engage with the respective positioning slots 303 to position the connector 100 on the PCB 300. The solder tail portions 23 of the electrical terminals 20 and the solder parts 32 of the solder blades 30 located in the dielectric housing 10 are soldered to the PCB 300 by surface mounting technology (SMT). The solder blades 30 serve to strengthen the solder connection between the connector 100 and the PCB 300.

Referring back to FIG. 3 and FIG. 4 again, the stop shoulder 114 is located in the bottom of the cylindrical microphone insertion cavity 13 and a little lower than the flexible contact portions 22 of the electrical terminals 20. When the microphone 200 is inserted into the cylindrical microphone insertion cavity 13, the stop shoulder 114 limits the insertion depth of the microphone 200 to prevent overstressing the flexible contact portions 22 of the electrical terminals 20.

Referring to FIGS. 5 and 6 again, as the cylindrical wall 12 of the microphone connector 100 sinks into the circular hole 301 of the PCB 300, only the supporting base 11 is retained over the PCB 300, so the microphone connector 100 has a lower profile over the PCB 300.

The ribs 121 engage with the positioning slots 303, so microphone connector 100 is positioned on the PCB 300 and is prevented from rotating in the circular hole 301. Therefore, before soldering, the solder tail portions 23 and the solder parts 32 are prevented from offsetting their proper positions on the PCB 300. Furthermore, the solder blades 30 strengthen the solder connection, so the microphone connector 100 is reliably retained on the PCB 300.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A low profile microphone connector mountable onto a printed circuit board, comprising:

a dielectric housing having a generally cylindrical wall, a generally cylindrical microphone insertion cavity defined by the cylindrical wall, a top open end and a bottom end, a supporting base being formed at a lower portion of said cylindrical wall and extending outwardly, the supporting base having a supporting surface opposite to said bottom end for abutting against a bottom face of the printed circuit board, a plurality of ribs being formed at an upper portion of said cylindrical wall and outside said cylindrical wall for positioning the connector on the printed circuit board; and electrical terminals located in the supporting base, each electrical terminal having a solder tail portion extending outside the dielectric housing from the supporting surface of the supporting base and a flexible contact portion projecting into the microphone insertion cavity for electrically engaging with a microphone which is adapted to be inserted into the microphone insertion cavity through the top open end.

2. The low profile microphone connector as set forth in claim 1, further comprising a plurality of solder blades located in the supporting base, each solder blade having a solder part extending outside the dielectric housing from the supporting surface of the supporting base.

3. The low profile microphone connector as set forth in claim 2, wherein the solder tail portions of the electrical terminals and the solder parts of the solder blades are symmetrically distributed on the supporting base.

4. The low profile microphone connector as set forth in claim 2, wherein the solder blades and the electrical terminals are mounted in the dielectric housing by insert molding.

5. The low profile microphone connector as set forth in claim 1, wherein the ribs are symmetrically distributed on the cylindrical periphery of said cylindrical wall.

6. The low profile microphone connector as set forth in claim 1, wherein the dielectric housing has a stop shoulder in the bottom of the microphone insertion cavity for limiting the insertion depth of the microphone to prevent overstressing the flexible contact portions of the electrical terminals.

7. A low profile microphone connector assembly, comprising:

a printed circuit board having a generally circular hole and a plurality of positioning slots defined along the periphery of the circular hole; and a microphone connector mounted onto the printed circuit board, the microphone connector comprising:

a dielectric housing having a generally cylindrical wall sunk into said circular hole of said printed circuit board, a generally cylindrical microphone insertion cavity defined by the cylindrical wall, a top open end and a bottom end, a supporting base being formed at a lower portion of said cylindrical wall and extending outwardly, the supporting base having a supporting surface opposite to said bottom end for abutting against a bottom face of the printed circuit board, a plurality of ribs being formed at an upper portion of said cylindrical wall and outside said cylindrical wall for engaging with said positioning slots to position the connector on the printed circuit board; and electrical terminals located in the supporting base, each electrical terminal having a solder tail portion extending outside the dielectric housing from the supporting surface of the supporting base to be soldered to the printed circuit board and a flexible contact portion projecting into the microphone insertion cavity for electrically engaging with a microphone which is adapted to be inserted into the microphone insertion cavity through the top open end.

8. The low profile microphone connector assembly as set forth in claim 7, wherein the microphone connector further comprises a plurality of solder blades located in the supporting base, each solder blade has a solder part extending outside the dielectric housing from the supporting surface of the supporting base to be soldered to the printed circuit board.

9. The low profile microphone connector assembly as set forth in claim 8, wherein the solder tail portions of the electrical terminals and the solder parts of the solder blades are symmetrically distributed on the supporting base.

10. The low profile microphone connector assembly as set forth in claim 7, wherein the dielectric housing has a stop shoulder in the bottom of the microphone insertion cavity for limiting the insertion depth of the microphone to prevent overstressing the flexible contact portions of the electrical terminals.

* * * * *